United States Patent [19]

Laurin

[11] Patent Number: 4,930,196

[45] Date of Patent: Jun. 5, 1990

[54] SLIP RESISTANT SHOE LACE

[75] Inventor: André Laurin, Montreal, Canada

[73] Assignee: Locklace Industries Ltd., Montreal, Canada

[21] Appl. No.: 325,187

[22] Filed: Mar. 17, 1989

[51] Int. Cl.[5] ..... A43C 9/00

[52] U.S. Cl. ..... 24/715.3; 24/715.4

[58] Field of Search ..... 24/143 R, 143 A, 306, 24/429; 434/260; 36/114

[56] References Cited

U.S. PATENT DOCUMENTS

| | | | |
|---|---|---|---|
| 576,056 | 1/1897 | Kempshall | 24/143 R |
| 586,771 | 7/1897 | Kempshall | 24/143 R |
| 957,559 | 5/1910 | Holt | 24/143 R |
| 1,513,871 | 11/1924 | Staniewicz | 24/143 A |
| 1,649,027 | 11/1927 | Gunn | 24/143 R |
| 1,767,732 | 6/1930 | Breadon | 24/143 R |
| 1,948,844 | 2/1934 | Dawes | 24/143 R |
| 2,477,151 | 7/1949 | Stapleton . | |
| 2,639,481 | 5/1953 | Lester . | |
| 3,906,642 | 9/1975 | Cohen | 434/260 |
| 3,947,928 | 4/1976 | Maldonado . | |
| 4,017,984 | 4/1977 | Bonfigli | 434/260 |
| 4,247,967 | 2/1981 | Swinton | 24/306 |
| 4,604,775 | 8/1986 | Kusayama | 24/429 |
| 4,651,447 | 3/1987 | Sullivan . | |

*Primary Examiner*—Victor N. Sakran

*Attorney, Agent, or Firm*—Edwin E. Greigg

[57] ABSTRACT

A novel slip resistant shoe lace includes an elongated flexible member having a pair of ends, a front face and a back face. A continuous strip of rubber, preferably colored resin material, is applied to and extends along the front and back faces of the elongated member.

3 Claims, 2 Drawing Sheets

SLIP RESISTANT SHOE LACE

BACKGROUND OF THE INVENTION (a) Field of the Invention

The present invention relates to a slip resistant shoe lace.

(b) Brief Description of the Prior Art

U.S. Pat. No. 2,477,151 of H. J. STAPLETON granted on July 26, 1949 describes a shoe lace comprising a braided, flat, relatively wide and relativelly yieldable body member, and a braided, round, relatively unyieldable strand woven back and forth centrally through the body member. The reaches of the strand provide longitudinally spaced, raised, alternately disposed ribs on the sides of the body member.

Also known in the art is U.S. Pat. No. 4,247,967 of Walter C. SWINTON granted on Feb. 3, 1981. In this patent, there is described a slip resistant binding comprising a strip of material having first and second ends. The strip has a multiplicity of male, hook-shaped filament members adjacent to its first end, and a multiplicity of female, loop-shaped filament members adjacent to its second end. The male filament members and the female filament members releasably interengage each other at crossover points of first and second portions of the strip.

One of the drawbacks with the above described laces resides in the fact that these laces are difficult to mass produce in an efficient manner. Another drawback with these laces is that they are not attractive.

OBJECT OF THE INVENTION

It is an object of the present invention to produce a slip resistant shoe lace that is easy to mass produce.

It is another object of the present invention to provide a slip resistant shoe lace that is attractive for the eyes.

SUMMARY OF THE INVENTION

According to the present invention, there is provided a slip resistant shoe lace comprising:

an elongated flexible member having a pair of ends, a front face, and a back face; and a continuous strip of rubbery, preferably colored, resin material disposed along said elongated member on at least one of said faces.

According to the present invention, there is also provided a process for making a slip resistant shoe lace, comprising the steps of:

(a) unwinding an elongated flexible member having front and back faces from around a first spool;

(b) rewinding said unwinding elongated flexible member around a second spool in such a manner that a section of said elongated member in unwound form moves between said first and second spools; and (c) spreading a continuous strip of a rubbery resin material over at least one of said front and back faces of said section when said elongated member is moving between said first and second spools.

BRIEF DESCRIPTION OF THE DRAWINGS

The objects, advantages and other features of the present invention will become more apparent upon reading of the following non-restrictive description of preferred embodiments thereof, given for the purpose of examplification only with reference to the accompanying drawings.

DETAILED DESCRIPTION OF PREFERRED EMBODIMENTS

Figure 1:
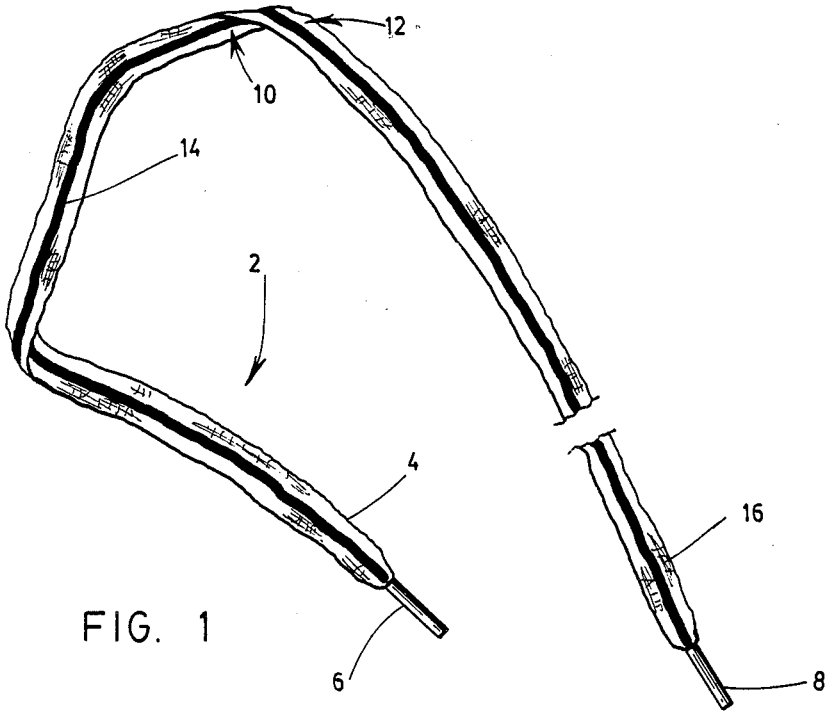
FIG. 1 is a fragmentary perspective view of a slip resistant shoe lace according to the present invention.

In FIG. 1, there is shown a slip resistant shoe lace 2 according to the present invention. This shoe lace 2 comprises an elongated flexible member 4 preferably made of woven textile fabric as is known in the shoe lace industry, having a pair of ends 6 and 8, a front face 10, and a back face 12. The shoe lace 2 also comprises two longitudinal strips 14 and 16 disposed respectively on the front and back faces 10 and 12, along the elongated member 4. Each longitudinal strip 14 and 16 is continuous and made of rubbery - not to say sticky - resin material disposed along the elongated member 4 on each of the faces 10 and 12. This material, which can be of very bright color for decorative purpose, is preferably made of a tough rubber coating such as the one sold under the trademark Color Guard, by Loctite (trademark). Mechanical as well as adhesive friction is provided by means of the contact between the material and the shoe tongue, and the contact between the material and the eyelets of the shoe.

Figure 2:
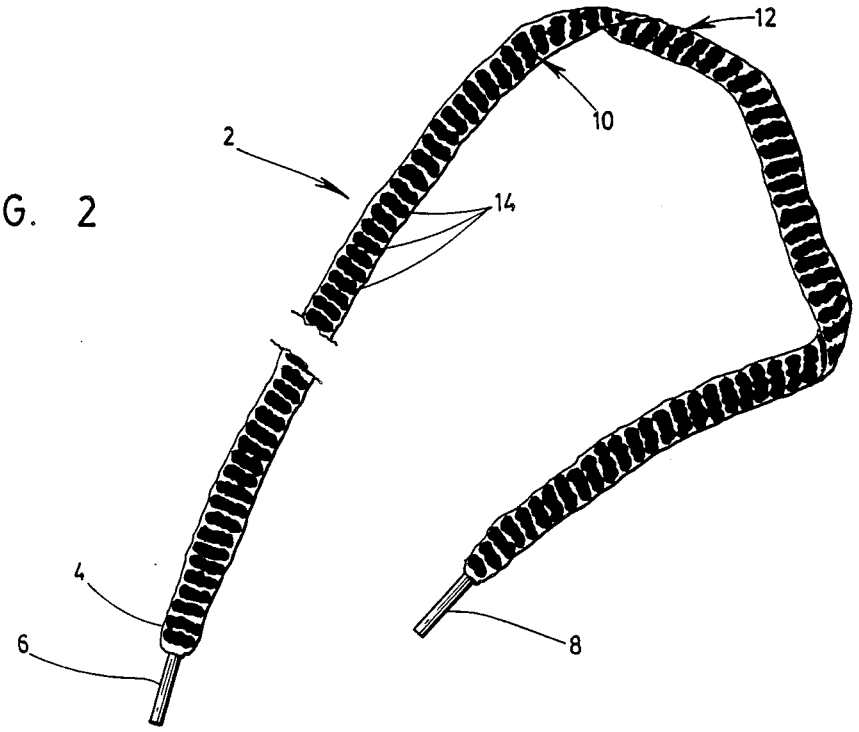
FIG. 2 is a fragmentary perspective view of another embodiment of another slip resistant shoe lace according to the present invention.

Referring now to FIG. 2, there is shown another slip resistant shoe lace 2 according to the present invention. The shoe lace 2 shown in FIG. 2 comprises an elongated flexible member 4 having a pair of ends 6 and 8, front face 10, and a back face 12. This shoe lace 2 also comprises transverse adjacent bars 14 disposed along the elongated member 4 on the front and back faces 10 and 12 to form a continuous strip. These transverse adjacent bars 14 are formed of a colored resin material disposed along the elongated member 4 on each of the faces 10 and 12. Each of the transverse adjacent bars 14 preferably has a color different from the color of an adjacent strip.

The material is also made of a tough rubber coating which can be, for instance, Color Guard (trademark) made by Loctite (trademark).

Figure 3:
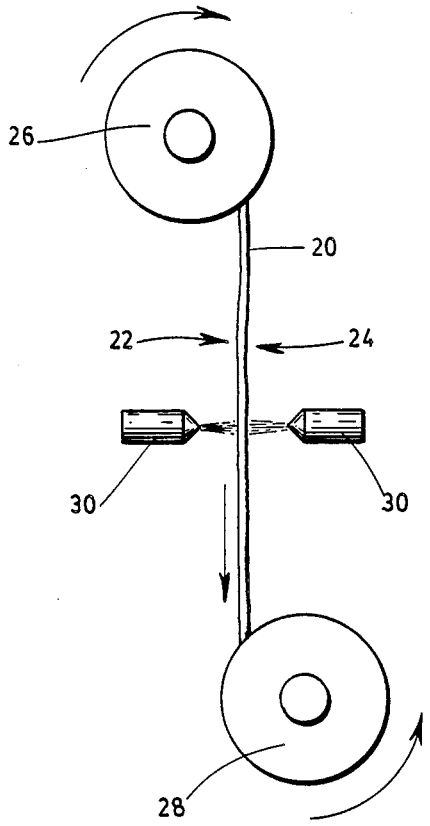
FIG. 3 is a schematic diagram illustrating a process for making a slip resistant shoe lace according to the present invention.

The process for making the slip resistant shoe lace according to the present invention is illustrated in FIG. 3. This process comprises the steps of (a) unwinding an elongated flexible member 20 having front and back faces 22 and 24 from around a first spool 26; (b) simultaneously rewinding the unwinding elongated flexible member 20 around a second spool 28 in such a manner that a section of the elongated member in unwound form moves between the first and second spools 26 and 28; and (c) spreading a continuous strip of rubbery resin material over at the front and back faces 22 and 24 of the section while the elongated member moves between the first and second spools 26 and 28 to make the slip resistant shoe lace.

In the embodiment shown in FIG. 1, the spreading step is carried out by spraying the resin with nozzles 30. In the embodiment shown in FIG. 2, the spreading step may be carried out with a set of cogged wheels whose teeth dip into the resin to be spread and then move into contact with the elongated member. The continuous resin material is preferably a tough rubber coating.

Although the present invention has been explained hereinabove by way of preferred embodiments thereof, it should be pointed out that any modifications to these preferred embodiments, within the scope of the appended claims, is not deemed to change or alter the nature of scope of the present invention.

What is claimed is:

1. A slip resistant shoe lace comprising:

an elongated flexible member having an elongated body terminated by first and second ends, a front face, and a back face; and a strip of rubbery resin material disposed along at least a portion of said elongated body of said elongated flexible member on an outside surface of at least one of said faces and extending between said first and second ends, said strip of rubbery resin material being formed of a plurality of contiguous transverse bars along said portion of said elongated body.

2. A slip resistant shoe lace as defined in claim 1, wherein each of said contiguous transverse bars has a color different from the color of an adjacent transverse bar.

3. A slip resistant shoe lace as defined in claim 2, wherein said resin material consists of a tough rubber coating of bright colors.

* * * * *